US005336658A

United States Patent [19]

Edwards

[11] Patent Number: 5,336,658

[45] Date of Patent: Aug. 9, 1994

[54] THERMAL TRANSFER PRINTING RECEIVER

[75] Inventor: Paul A. Edwards, Harwich, England

[73] Assignee: Imperial Chemical Industries PLC, London, England

[21] Appl. No.: 970,389

[22] Filed: Nov. 2, 1992

[30] Foreign Application Priority Data

Nov. 1, 1991 [GB] United Kingdom ..... 9123267.8

[51] Int. Cl.[5] ..... B41M 5/035; B41M 5/38

[52] U.S. Cl. ..... 503/227; 428/195; 428/206; 428/323; 428/328; 428/447; 428/800; 428/913; 428/914

[58] Field of Search ..... 8/471; 428/195, 913, 428/914, 206, 323, 328, 447, 500; 503/227

[56] References Cited

U.S. PATENT DOCUMENTS 4,720,480 1/1988 Ito et al. ..... 503/227
4,778,782 10/1988 Ito et al. ..... 503/227
4,837,200 6/1989 Kondo et al. ..... 503/227
4,908,345 3/1990 Egashira et al. ..... 503/227

*Primary Examiner*—B. Hamilton Hess
*Attorney, Agent, or Firm*—Cushman, Darby & Cushman

[57] ABSTRACT

In a receiver sheet for dye-diffusion thermal transfer printing, a receiver coat of dye-receptive polymer containing a crosslinked silicone release system, is protected against loss of release function when overlying a substrate or coating containing particulate metal salts or metal oxides, by a protective polymeric interlayer comprising an acidic polymer composition selected from:

a) an addition polymer in which at least 30% of its monomer molecule residues contain at least one carboxylic acid group,
b) a blend of at least two addition polymers in which at least 30% of the monomer molecule residues in the blend contain at least one carboxylic acid group,
c) a crosslinked addition polymer wherein the addition polymer molecules are substantially crosslinked to form an insoluble polymer matrix in the presence of excess strong organic acid.

13 Claims, No Drawings

THERMAL TRANSFER PRINTING RECEIVER

The invention relates to thermal transfer printing, and especially to receivers having improved resistance to sticking during printing.

Thermal transfer printing is a generic term for processes in which one or more thermally transferable dyes are caused to transfer from a dyesheet to a receiver in response to thermal stimuli. Using a dyesheet comprising a thin substrate supporting a dyecoat containing one or more such dyes uniformly spread over an entire printing area of the dyesheet, printing can be effected by heating selected discrete areas of the dyesheet while the dyecoat is pressed against a receiver sheet, thereby causing dye to transfer to corresponding areas of that receiver. The shape of the pattern transferred is determined by the number and location of the discrete areas which are subjected to heating. Full colour prints can be produced by printing with different coloured dyecoats sequentially in like manner, and the different coloured dyecoats are usually provided as discrete uniform print-size areas in a repeated sequence along the same dyesheet.

A typical receiver sheet comprises a substrate supporting a receiver coat of a dye-receptive composition containing a material having an affinity for the dye molecules, and into which they can readily diffuse when the adjacent area of dyesheet is heated during printing. Such receiver coats are typically around 2–6 μm thick, and examples of suitable materials with good dye-affinity include saturated polyesters, soluble in common solvents to enable them readily to be applied to the substrate as coating compositions, and then dried to form the receiver coat.

Various sheet materials have been suggested for the substrate, including for example, cellulose fibre paper, thermoplastic films such as biaxially orientated polyethyleneterephthalate film, filed and/or voided plastic films such as pearl film, films coated with micro-voided compositions to give them paper-like handling qualities (hence generally referred to as "synthetic paper"), and laminates of two or more such sheets.

High resolution photograph-like prints can be produced by dye-diffusion thermal transfer printing using appropriate printing equipment, such as a programmable thermal print head or laser printer, controlled by electronic signals derived from a video, computer, electronic still camera, or similar signal generating apparatus. A typical thermal print head has a row of individually operable tiny heaters spaced to print six or more pixels per millimetre, generally with two heaters per pixel. The greater the density of pixels, the greater is the potential resolution, but as presently available printers can only print one row at a time, it is desirable to print them at high speed with very short hot pulses, usually from near zero up to about 10 ms long, but even up to 15 ms in some printers, with each pixel temperature typically rising to about 350° C. during the longest pulses.

The materials of good dye-affinity commonly used, such as the saturated polyesters referred to above, are generally thermoplastic polymers with softening temperatures below the temperatures used during printing. Although the printing pulses are so short, they can be sufficient to cause a degree of melt bonding between the dyecoat and receptive layer, the result being total transfer to the receiver of whole areas of the dyecoat. The amount can vary from just a few pixels wide, to the two sheets being welded together over the whole print area.

To overcome such total transfer problems arising during printing, there have been various proposals for incorporating release systems into the receiver coat compositions. Particularly effective release systems include silicones and crosslinking agents to react with the silicones, which can be incorporated into the receiver coating composition containing the dye-receptive materials, such that crosslinking can be effected after the composition has been coated onto the substrate to form the receiver coat. This crosslinking stabilizes the coat and prevents the silicone migrating.

We have now noticed however, that the effectiveness of the release system can vary with changes in the substrate used, and that it can be quite badly impaired when the receiver coat has an underlying layer containing particulate metal oxides or metal salts. This layer may be the supportive sheet forming the substrate, or a coating applied to that substrate. The effect is most noticeable when the surface of the particle-filled layer is in direct contact with the receiver coat, though some effect may also be observed with various polymer layers between them.

Examples of particles which can cause such problems include calcium carbonate and aluminum silicate (as found in various clays), or mixtures of the two, which are frequently used as whitenets, either using their own inherent whiteness or by producing small voids in a surrounding polymeric binder when the material is stretched, the whiteness coming from light scattering at the void/polymer interface. Particularly bad is titanium dioxide, which is a commonly used whitening agent in thermal transfer receivers, and this can lead to total transfer problems during printing, despite the receiver layer incorporating a release system which is fully effective when titanium dioxide is absent.

We have now found that such problems can be alleviated by providing an appropriate interlayer between the receiver layer and the metal salts or oxides. However, unless the interlayer composition is selected with care, this can lead to other problems, as will be indicated hereinbelow.

According to the present invention, a receiver sheet for thermal transfer printing comprises a substrate having particulate metal salts or metal oxides dispersed therein or in a coating supported by the substrate, and an overlying receiver coat consisting essentially of a dye-receptive polymer composition doped with a crosslinked silicone release system, characterised in that there is provided between the receiver coat and the particulate metal salts or oxides, a protective polymeric interlayer comprising an acidic polymer composition selected from:

a) an addition polymer in which at least 30% of its monomer molecule residues contain at least one carboxylic acid group, b) a blend of at least two addition polymers in which at least 30% of the monomer molecule residues in the blend contain at least one carboxylic acid group, c) a crosslinked addition polymer wherein the addition polymer molecules are substantially cross-linked to form an insoluble polymer matrix in the presence of excess strong organic acid.

To provide an effective barrier between the receiver layer and substrate, the acidity needs to held in the interlayer not only when the interlayer is applied to the substrate, but also when the receiver layer is applied on top, and cured. To achieve these objectives, one method according to the invention is to use a polymer composition as specified in part a or b wherein the addition polymers are homopolymers or copolymers of ethylenically unsaturated monocaroboxylic acids or polycarboxylic acids. Examples of such acids include acrylic acid, methacrylic acid, fumaric acid and maleic acid, wherein the latter is preferably in the form of a partial ester rather than its anthydride. Esterification can be carried out after polymerisation. Particularly suitable are copolymers based on acrylic acid and partially esterified maleic acid.

Homopolymers of these acids can provide good protection against the above problems of total transfer, but in their turn they can also create certain undesirable side effects. In particular, their high water compatibility can lead to an undesirably high uptake of water under conditions of high humidity. This tends to make the receiver feel sticky, and cause feed problems during printing. To overcome these side effects, we prefer to use a copolymer of the acid with at least one other monomer that is less hydrophilic than the acid, to reduce the water solubility of the polymer. For example, acrylic (including methacrylic) esters (especially the lower alkyl, eg methyl and ethyl esters) are readily copolymerised with the acrylic acids, and even small amounts of such esters, eg 5 or preferably 10%, can be sufficient to reduce such problems to a low level, with larger amounts giving increased resistance. However, going to the other extreme and adding much larger proportions of the esters can raise other problems, as will now be described.

During manufacture, the receiver layer is normally applied to the substrate in the form of a solution in a common organic solvent, typically toluene, methyl ethyl ketone, or a mixture of these. The present interlayer is required to separate the receiver layer from the particulate material it is to overlie, and it is therefore desirable that the interlayer shall remain undisturbed as a complete unbroken layer when the receiver coat solution is applied on top of it. With this in mind, we prefer that the interlayer be substantially insoluble in the solvents used for the receiver coat composition, but the addition of further monomers such as acrylic esters increases the solubility of such copolymers in the receiver layer solvents. It is therefore desirable to limit the proportion of the esters in such copolymers. A preferred receiver is one wherein 50–90% of the addition monomer molecule residues in the interlayer contain at least one carboxylic acid group.

Particularly preferred is a polymer interlayer comprising an acrylic acid polymer in which the acrylic acid content is at least 50% by weight of the total polymer.

Suitable such coplymers can be obtained commercially. Examples include, Rohagit S, an acrylic acid/acrylic ester copolymer containing about 90% by weight of acrylic acid, which is sold by Rohm & Haas. This can be used on it own with little noticeable water retention, though in general we prefer to blend such copolymers with polymers of lower acrylic acid content. Other copolymers include Carboset 525 from B. F. Goodrich. This is an ethyl acrylate/acrylic acid copolymer having only 10% of its weight as acrylic acid. As explained above, such low acrylic acid content can lead to copolymers with an undesirably high organic solubility when used on their own, but it can be useful for blending with another polymer of higher acrylic acid content to bring the overall acrylic acid content within our above preferred composition range.

The acid equivalent of the acrylate ester/acrylic acid copolymer may be increased by the addition of an organic strong acid, such as p-toluenesulphonic acid (PTSA) or phthallic acid. Suitably the interlayer contains 1–30% by weight of the organic strong acid in addition to any carboxylic acid of the addition polymer.

The other series of acids specifically referred to above, is the unsaturated dicarboxylic acids like fumaric and maleic acids, especially the latter in the form of its partial esters. Like the acrylic acid polymers referred to above, we prefer that the maleic acid esters be copolymerised with a less hydroponilic comonomer. Preferred such copolymers are partially esteriliad styrene/maleic anthydride copolymers. These have the general formula below.

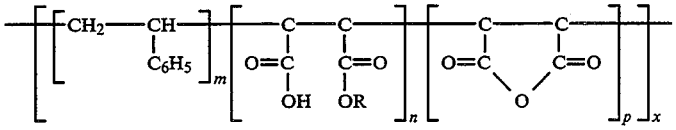

In commercial products these esters are variously referred to as "esteriliad" or "partially esterified", but however described in the commercial literature, it is copolymers having free carboxylic acid groups, ie when n is not zero in the formula above, which are applicable to the present invention. Typical esterification of commercial partial esters is quoted as 30–50%, and materials for which p lies within the range O-n, can be used, the lower p values being preferred.

The relative values of m and n that are suitable in the present context, are governed by essentially the same criteria as the preferred ratios of the acrylic acid and ester copolymers described above. However, a greater proportion of styrene residues can be used without undue solubility increase, than was the case for acrylic acids, although the polymers at the upper end of such ranges in respect of the carboxylic acid content are preferred, unless the acidity is boosted by the addition of an organic strong acid such as PTSA.

We generally prefer to use low molecular weight copolymers, as these are readily soluble in both aqueous (eg ammoniacal or containing other volatile amines such as morpholine) and the more polar of the organic solvents, such as methanol, acetone and diacetone alcohol (D.A.A), or mixtures of these. Copolymers having styrene/maleic ratios of 1:1 to 3:1, and average molecular weights within the range 1,000–200,000, are particularly convenient.

Examples of such copolymers that are commercially available include the range of partially esterfied copolymers marketed by Sartomer Company, under the name "SMA Resins". Their commercial literature quotes the following values for the variables in the general formula I, ie m=1–3, n=1, and x=6–8. Other such copolymers are marketed by Monsanto Chemical Company, as "Scripset Resins", and their literature refers to them as esters, having a styrene:maleic ratio >1, and average molecular weights ranging from 105,000 to 180,000, according to the series selected, the molecular weight distributions being broad.

When used on their own, we find that the maleic anhydride copolymers can give a rather brittle interlayer, and we generally prefer to blend them with a plasticising polymer, eg in amounts of 5–40% by weight of the copolymer. Plasticising polymers having an abundance of free carboxylic acid groups, enable a common solvent to be used, and particularly suitable as plasticising resins are acrylic acid or methacrylic acid copolymers with at least one other monomer which is less hydrophilic than the acid, eg as referred to above.

The polymer compositions discussed above with particular reference to options a and b are based on ethylenically unsaturated carboxylic acids, copolymerised with copolymers of less hydrophiiic monomers to give a suitable overall balance between water solubility and solubility in the receiver layer solvents, and on blends of such polymers selected to give such balance overall. In option c, the objective of protecting the release system is similarly achieved by the provision of an acidic interlayer of addition polymers, but unwanted solubility in the receiver layer solvents is avoided by crosslinking the addition polymers to form an insoluble matrix in the presence of strong acids.

Preferred addition polymers for option c are polymers having a plurality of hydroxyl groups available for acid catalysed crosslinking reactions. We find that the required acid barrier can be achieved just by the excess of strong organic catalysing acid which becomes locked into the crosslinked matrix. Nevertheless, for providing an overall balance of properties, addition polymers or blends of addition polymers are preferred which do contain at least 10% of monomer molecule residues having at least one carboxylic acid group per molecule, especially the polymers described above for options a and b, either alone or together with other polymers having a plurality of hydroxyl groups.

Suitable crosslinking agents include polyfunctional N-(alkoxymethyl)amino resins, reactive in acid conditions with the hydroxyl groups of the carboxylic acid groups. These crosslinking agents include alkoxymethyl derivatives of urea, guanamine and melamine resins. Lower alkyl compounds (ie up to the $C_4$ butoxy derivatives) are available commercially and all can be used effectively, but the methoxy derivative is much preferred because of the greater ease with which its more volatile by-product (methanol) can be removed afterwards. Examples of the latter include hexamethoxymethylmelamines, suitably used in a partially prepolymerised (oligomer) form to obtain appropriate viscosities, such as Cymel 303, sold by American Cyanamid. Cymel 1171, a highly alkylated glycoluril resin, will also react with the copolymers in the presence of a strong organic acid like the PTSA used to enhance the acrylic acid content. Other suitable cross linking agents include Beetle BE692 and Beetle BE659, which are butylated benzoguanamine and butylated melamine formaldehyde resins respectively, from BIP Chemicals.

EXAMPLES

Examples 1–9

To illustrate the invention, a series of different receivers was made, some with interlayers according to the invention and others without for comparison purposes. Four different substrates were used. Three had particulate metal oxides or their salts in the surface to be coated, and the other had none, being used as a control. Three protective interlayers, were evaluated, each being applied as a coating on each of the four substrates in turn. These were then each coated with a receiver layer, and the resultant receivers evaluated by printing in a Hitachi VY200 printer. The prints were examined for evidence of total transfer, or any other evidence of loss in release efficiency.

The various layers were as follows.

The substrates had the following surface layers or compositions:

I. A white coating on a supporting substrate. The coating was rutile titanium dioxide dispersed in a polyester urethane binder.

II. Pearl film. This was a commercial voided polypropylene film, which had been extruded as a polymer composition filled with calcium carbonate and china clay (mainly hydrated aluminum silicate), and drawn to produce microvoids.

III. Voided polyester film. This was a low density polyethyleneterephthalate film filled with barium sulphate and drawn to produce the voids.

IV. OHP grade Melinex. This was a transparent film from ICI, of biaxially orientated polyethyleneterepnthalate film, and was free from particulate metal oxides or their salts.

The protective interlayers had the following compositions, each of the three being applied to the substrate as a solution in methanol, and dried.

| | | |
|---|---|---|
| A. | Rohagit S | 100 parts by weight |
| B. | Rohagit S | 75 parts by weight |
| | Carboset 525 | 25 parts by weight |
| | PTSA | 5 parts by weight |
| C. | Carboset 525 | 50 parts by weight |
| | Cymel 1171 | 50 parts by weight |
| | PTSA | 5 parts by weight |

The receiver layers were the same in each case, with an acid catalysed crosslinked release system. The coating composition was a solution of the following in a 60/40 toluene/MEK solvent mixture, which was then applied, dried and cured in situ:

| | |
|---|---|
| Vylon 200 | 100 parts by weight |
| Tegomer HSi 2210 | 0.7 parts by weight |
| Cymel 303 | 1.4 parts by weight |
| Tinuvin 900 | 1.0 parts by weight |
| PTSA | 0.4 parts by weight |

(Vylon 200 is a polyester having a high dye-affinity, sold by Toyobo. tegomer HSi 2210 is a bis-hydroxyalkyl polydimethysiloxane sold by Th Goldschmidt, which is cross-linkable by the Cymel 303 in the acid conditions. Tinuvin 900 is a UV absorber sold by Ciba-Geigy.)

Receiver sheets were prepared from the above materials according to the following table.

| Example | Substrate | Interlayer |
|---|---|---|
| 1 | I | A |
| 2 | I | B |
| 3 | I | C |
| C1 | I | none |
| 4 | II | A |
| 5 | II | B |

-continued

| Example | Substrate | Interlayer |
|---|---|---|
| 6 | II | C |
| C2 | II | none |
| 7 | III | A |
| 8 | III | B |
| 9 | III | C |
| C3 | III | none |
| C4 | IV | A |
| C5 | IV | B |
| C6 | IV | C |
| C7 | IV | none |

Result: Comparative Examples

In Comparative Examples C1–C3, none of the receivers had a protective interlayer of the invention. Receivers using substrates I, II, and III all showed deficient release properties. The problems were particularly bad with substrate i, filled with titanium dioxide, and total transfer frequently occurred over sizeable areas. With substrate II, the pearl film, some total transfer did occur, but this was much less of a problem than that encountered with substrate Release from receivers using substrate III was better than with either of the other two, and problems were only found in samples that had undergone simulated aging, especially where release systems had not been fully cured.

In Comparative Examples C4–C7 the substrates were all substrate IV, this being the substrate having no particulate metal oxides or their salts, and three interlayers were applied as shown in the above table. No problems of total transfer were experienced, indicating that such problems were caused by the presence of the particulate metal oxides and salts in the substrate and covering $TiO_2$ layer.

Results: Examples 1–9

The receivers of Examples 1–9 each had an interlayer according to the invention, between the receiving layer and the substrate (including coating where appropriate). In none of these Examples did we detect any sign of total translet, nor indeed any other indication of a deterioration of release properties.

As no changes hag consciously been made to the receiver recipes other than the provision of the interlayers as specified in the table, the results indicate that such interlayers effectively protected the release systems from adverse effects induced by the metal oxides and their salts.

Examples 10–18

Further receivers were prepared using the following interlayer compositions which varied from a low acid blend of uncrosslinked copolymers, in which about 50% was derived from acrylic acid (compared with the 90% of Example 1), to crosslinked compositions ranging from one in which most of the acidity was derived from the strong organic acid used to catalyst the crosslinking, to another in which about 60% of the addition polymer was derived from acrylic acid. The use of an acidic copolymer based on other than acrylic acid monomer, is also exemplified. The interlayer compositions were prepared and coated in the manner of the preceding Examples, from solutions of the following materials.

Example 10

50 parts Rohagit S
50 parts Carboset 525

Example 11

50 parts Carboset 525
50 parts Cymel 1171
10 parts PTSA

Example 12

25 parts Carboset 525
75 parts BE659
5 parts PTSA

Example 13

50 parts Carboset 525
50 parts BE659
5 parts PTSA

Example 14

62.5 parts Carboset 525
12.5 parts Rohagit S
25 parts BE659
5 parts PTSA

Example 15

70 parts Carboset 525
5 parts poly(acrylic acid)
25 parts BE659
5 parts PTSA

Example 16

60 parts Scripset 540
20 parts Rohagit S
20 parts BE659
5 parts PTSA

Example 17

60 parts Carboset 525
15 parts PVP K90
25 parts BE659
5 parts PTSA

Example 18

30 parts Rohagit S
15 parts Digol
55 parts BE659
5 parts PTSA

The receivers of Examples 10–18 were evaluated by making prints on a Hitachi VY200 printer in the manner of Examples 1–9, and like those earlier Examples, none of the receivers showed any deterioration of release properties ( as compared to the release properties of OHP grade substrate having no metal oxide or salt filler ), irrespective of whichever of receivers I, II or II were used.

I claim:

1. A receiver sheet for thermal transfer printing comprises a substrate having particulate metal salts or metal oxides dispersed therein or in a coating supported by the substrate, and an overlying receiver coat consisting essentially of a dye-receptive polymer composition doped with a crosslinked silicone release system, characterised in that there is provided between the receiver coat and the particulate metal salts or oxides, a protective polymeric interlayer comprising an acidic polymer composition selected from:

a) an addition polymer in which at least 30% of its monomer molecule residues contain at least one carboxylic acid group, b) a blend of at least two addition polymers which at least 30% of monomer molecule residues in the blend contain at least one carboxylic acid group, c) a crosslinked addition polymer wherein the addition polymer molecules are substantially crosslinked to form an insoluble polymer matrix in the presence of excess strong organic acid.

2. A receiver sheet as claimed in claim 1, characterised in that the interlayer comprises an addition polymer which is a polymer of at least one ethylenically unsaturated carboxylic acid selected from acrylic acid, methacrylic acid, fumaric acid, partial ester of maleic acid and partial ester of fumaric acid.

3. A receiver sheet as claimed in claim 2, characterised in that the addition polymer is a copolymer of at the least one ethylentically unsaturated carboxylic acid, with at least one other monomer that is less hydrophilic than the acid.

4. A receiver sheet as claimed in claim 3, characterised in that 50–90% of the addition monomer molecule residues in the interlayer contain at least one carboxylic acid group.

5. A receiver sheet as claimed in claim 2, characterised in that the protective polymeric interlayer comprises an acrylic acid polymer in which the acrylic acid content is at least 50% by weight of the total polymer.

6. A receiver sheet as claimed in claim 2, characterised in that the interlayer contains 1–30% by weight of an organic strong acid in addition to any carboxylic acid of the addition polymer.

7. A receiver sheet as claimed in claim 2, characterised in that the copolymers are partially esterified styrene/maleic anthydride copolymers having styrene/maleic ratios of 1:1 to 3:1, and average molecular weights within the range 1,000–200,000.

8. A receiver sheet as claimed in claim 7, characterised in that the styrene/maleic anthydride coplymer partial ester is blended with 5–40% of its weight of a plasticising resin.

9. A receiver sheet as claimed in claim 8, characterised in that the plasticising resin is an acrylic acid or methacrylic acid copolymer with at least one other monomer which is less hydrophilic than the acid.

10. A receiver sheet as claimed in claim 1 wherein the protective polymeric interlayer comprises the at least one addition polymer substantially crosslinked to form an insoluble polymer matrix in the presence of excess strong organic acid, characterised in that the addition polymers are polymers which had a plurality of hydroxyl groups per molecule, at least some of which hydroxyl groups have been reacted with a crosslinking agent to provide the crosslinked matrix.

11. A receiver sheet as claimed in claim 10, characterised in that the crosslinked polymers comprise addition polymers or blends of addition polymers containing at least 10% of monomer molecule residues having at least one carboxylic acid group per molecule, either alone or together with other polymers also having a plurality of hydroxyl groups.

12. A receiver sheet as claimed in claim 10 or claim 11, characterised in that the crosslinking agent is a polyfunctional N-(alkoxymethyl)amino resin, reactive in acid conditions with the hydroxyl groups of the addition polymer.

13. A receiver sheet according to claim 1 wherein the receiver coat contains an acid catalyzed crosslinked release system.

* * * * *